US009226058B2

(12) United States Patent
Harwood

(10) Patent No.: US 9,226,058 B2
(45) Date of Patent: Dec. 29, 2015

(54) MEDIA ASSEMBLY FOR A STRUCTURAL SUPPORT

(71) Applicant: Ronald Paul Harwood, West Bloomfield, MI (US)

(72) Inventor: Ronald Paul Harwood, West Bloomfield, MI (US)

( * ) Notice: Subject to any disclaimer, the term of this patent is extended or adjusted under 35 U.S.C. 154(b) by 358 days.

(21) Appl. No.: 13/706,886

(22) Filed: Dec. 6, 2012

(65) Prior Publication Data

US 2013/0142372 A1 Jun. 6, 2013

Related U.S. Application Data

(60) Provisional application No. 61/567,182, filed on Dec. 6, 2011, provisional application No. 61/674,904, filed on Jul. 24, 2012.

(51) Int. Cl.

| | |
|---|---|
| ***H04R 1/20*** | (2006.01) |
| ***H04R 1/02*** | (2006.01) |
| ***G08B 5/36*** | (2006.01) |
| ***H04R 1/34*** | (2006.01) |
| ***F21V 33/00*** | (2006.01) |
| *H04R 27/00* | (2006.01) |

(Continued)

(52) U.S. Cl.

CPC ..... *H04R 1/028* (2013.01); *F21V 33/0056* (2013.01); *G08B 5/36* (2013.01); *H04R 1/345* (2013.01); *F21S 8/086* (2013.01); *F21S 8/088* (2013.01); *F21W 2111/00* (2013.01); *F21W 2131/103* (2013.01); *H04R 27/00* (2013.01)

(58) Field of Classification Search

CPC .. H04R 1/028; H04R 2201/021; H04R 27/00; H04R 5/02; H04R 1/345

USPC ..... 381/345, 352, 160, 386, 390–395, 189

See application file for complete search history.

(56) References Cited

U.S. PATENT DOCUMENTS

| | | | |
|---|---|---|---|
| 3,326,321 | A | 6/1967 | Valuch |
| 3,329,235 | A | 7/1967 | Shaper |

(Continued)

FOREIGN PATENT DOCUMENTS

| | | |
|---|---|---|
| EP | 1754930 A1 | 2/2007 |
| GB | 1460753 | 1/1977 |

(Continued)

OTHER PUBLICATIONS

Soundsphere Loudspeakers, Model 110B Loudspeaker, 2008, Sonic Systems, Inc., 2 pages.

(Continued)

*Primary Examiner* — Adam B Dravininkas

(74) *Attorney, Agent, or Firm* — Brooks Kushman P.C.

(57) ABSTRACT

A speaker assembly is provided with a speaker, a housing mounted to the speaker, and a reflector spaced apart from and facing the speaker. The reflector has a generally convex central region and a plurality of circumferentially spaced lobes, each extending radially outward from the central region for reflecting acoustic vibrations from the speaker radially outboard from the reflector while providing gaps between the lobes for permitting acoustic vibrations to pass therethrough. A series of supports connect the housing and the reflector. The supports are spaced circumferentially about the housing for providing openings between the supports for an outlet of the reflected acoustic vibrations. Each of the supports is aligned with and externally visually conceals one of the lobes.

20 Claims, 3 Drawing Sheets

(51) Int. Cl.

| | |
|---|---|
| *F21S 8/08* | (2006.01) |
| *F21W 111/00* | (2006.01) |
| *F21W 131/103* | (2006.01) |

(56) References Cited

U.S. PATENT DOCUMENTS

| | | | | |
|---|---|---|---|---|
| 3,818,138 | A | 6/1974 | Sperrazza, Jr. | |
| 4,063,387 | A | 12/1977 | Mitchell | |
| 4,200,904 | A | 4/1980 | Doan | |
| 4,348,549 | A * | 9/1982 | Berlant | 381/99 |
| 4,474,258 | A | 10/1984 | Westlund | |
| 5,418,336 | A | 5/1995 | Negishi et al. | |
| 5,525,767 | A | 6/1996 | Fields | |
| 5,721,401 | A | 2/1998 | Sim | |
| 5,832,099 | A | 11/1998 | Wiener | |
| 5,988,314 | A | 11/1999 | Negishi | |
| 5,995,634 | A | 11/1999 | Zwolski | |
| 6,086,968 | A | 7/2000 | Horovitz | |
| 6,222,503 | B1 | 4/2001 | Gietema et al. | |
| 6,257,365 | B1 | 7/2001 | Hulsebus, II | |
| 6,345,685 | B1 | 2/2002 | Wells et al. | |
| 6,461,752 | B1 | 10/2002 | Leung | |
| 6,598,842 | B1 | 7/2003 | Yeh | |
| 6,738,483 | B1 | 5/2004 | Betts | |
| 6,769,509 | B2 | 8/2004 | Harwood | |
| 6,957,715 | B2 | 10/2005 | Christiansen | |
| 7,219,873 | B2 | 5/2007 | Harwood | |
| 7,606,379 | B2 | 10/2009 | Ivey et al. | |
| 7,607,512 | B2 | 10/2009 | Harwood | |
| 8,098,852 | B2 | 1/2012 | Harwood et al. | |
| 2004/0070518 | A1 | 4/2004 | Whittle, Jr. et al. | |
| 2004/0248511 | A1 | 12/2004 | Flynn | |
| 2005/0083676 | A1 * | 4/2005 | VanderSchuit | 362/84 |
| 2005/0185398 | A1 | 8/2005 | Scannell, Jr. | |
| 2006/0043737 | A1 | 3/2006 | Ashikian | |
| 2006/0231328 | A1 | 10/2006 | Moore | |
| 2007/0045040 | A1 * | 3/2007 | Harwood | 181/199 |
| 2007/0191075 | A1 | 8/2007 | Greene et al. | |
| 2009/0267540 | A1 | 10/2009 | Chemel et al. | |
| 2010/0002320 | A1 | 1/2010 | Minano et al. | |
| 2010/0085751 | A1 | 4/2010 | Shaner | |
| 2010/0162685 | A1 | 7/2010 | Hirshberg | |
| 2011/0135121 | A1 * | 6/2011 | Harwood et al. | 381/160 |
| 2012/0076328 | A1 | 3/2012 | Harwood | |

FOREIGN PATENT DOCUMENTS

| | | |
|---|---|---|
| JP | 10096535 A | 4/1998 |
| KR | 2020090000034 | 1/2009 |
| KR | 2020090000060 | 1/2009 |

OTHER PUBLICATIONS

Soundsphere Loudspeakers, Model Q-6 Loudspeaker, 2006, Sonic Systems, Inc., 2 pages.

Soundsphere Loudspeakers, Model Q-8 Loudspeaker, 2007, Sonic Systems, Inc., 2 pages.

Soundsphere Loudspeakers, Model Q-12A Loudspeaker, 2008, Sonic Systems, Inc., 2 pages.

Soundsphere Loudspeakers, Model Q-15 Loudspeaker, 2008, Sonic Systems, Inc., 2 pages.

Soundsphere Loudspeakers, Model Q-LB Loudspeaker, 2006, Sonic Systems, Inc., 2 pages.

Soundsphere Loudspeakers, Model Q-SB2 Loudspeaker, 2008, Sonic Systems, Inc., 2 pages.

U.S. Appl. No. 13/330,103, "Acoustic Reflector and Energy Storage for Media Assemblies", filed Dec. 19, 2011, 26 pages.

U.S. Appl. No. 13/644,789, "Acoustically Transparent Luminaire Lens for Media Assemblies", filed Oct. 4, 2012, 20 pages.

* cited by examiner

MEDIA ASSEMBLY FOR A STRUCTURAL SUPPORT

CROSS-REFERENCE TO RELATED APPLICATIONS

This application claims the benefit of U.S. provisional Application No. 61/567,182, filed on Dec. 6, 2011, and U.S. provisional Application No. 61/674,904, filed on Jul. 24, 2012, the disclosures of which are incorporated in their entirety by reference herein.

TECHNICAL FIELD

Various embodiments relate to media assemblies for structural supports.

BACKGROUND

Many outdoor and indoor public areas utilize speakers, speaker systems or public address systems for reproducing sound in these areas. These areas may include city streets, parks, residential neighborhoods, office buildings, campus areas, exterior walkways, shopping malls, casinos, atriums, and the like. These areas typically utilize speakers or speaker systems that are mounted to existing building structures, structural poles, or the like. Much effort is employed in installation of these systems and protecting these speaker systems from vandalism, wind load and/or the weather. Also, efforts have been directed towards protecting the associated wires or cables provided to these speaker systems. The prior art provides a plurality of methods and apparatuses for mounting speakers and speaker systems in public areas. The prior art also provides apparatuses for protecting these speakers from the elements. Further, the prior art has offered solutions for concealing speakers systems in public areas. Two prior art examples include Harwood U.S. Pat. No. 6,769,509 B2; and Harwood U.S. Pat. No. 7,219,873 B2.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
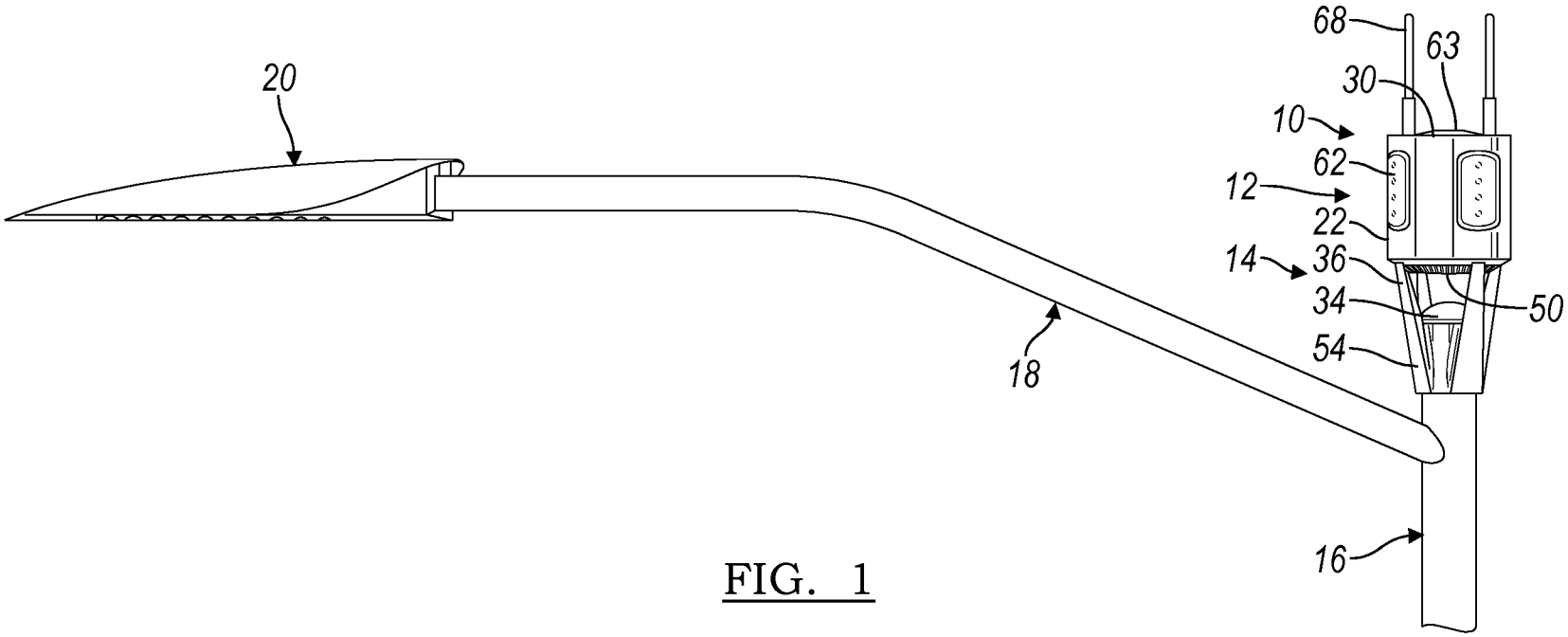
FIG. 1 is a perspective view of a media assembly and structural support according to an embodiment.

Referring now to FIG. 1, a media assembly is illustrated as a post top module according to at least one embodiment and is referenced generally by numeral 10. The media assembly

10 includes a combination of an indicator light assembly 12 and a speaker assembly 14. The indicator light assembly 12 and the speaker assembly 14 are illustrated mounted upon a structural support, such as a structural light pole 16 for supporting the indicator light assembly 12 and the speaker assembly 14 upon an underlying support surface and for elevating the indicator light assembly 12 and the speaker assembly 14 above the underlying support surface. The structural pole 16 may include a laterally extending arm 18 for supporting another light assembly, such as a luminaire 20 for illuminating an underlying thoroughfare such as a road or other vehicle path. The media assembly 10 is oriented on top of the structural pole 16 in order to convey media, such as sound and other information wherein this information is more readily perceived, such as a pedestrian thoroughfare or walkway.

Although the media assembly 10 is illustrated mounted to the structural pole 16, the invention contemplates various structural supports for the media assembly, including street poles, light poles, sign poles, direct surface mounting, pendant lighting, catenary lighting, or the like.

Referring now to FIGS. 1-5, the media assembly 10 includes a housing 22 for housing a downward-facing speaker 24. The housing 22 has a lower opening 26 for seating a mounting flange 28 of the speaker 24. The housing 22 is enclosed at an upper opening with a cap 30 for providing a resonating chamber 32 for the speaker 24. The housing 22 may be formed generally cylindrical as illustrated or may be embodied in various shapes. The housing 22 may be cast from aluminum, molded or formed by any other suitable materials and manufacturing processes.

Prior art speaker assemblies that focus a single speaker directly downward provide an uneven range of coverage. A reflector 34 is provided for evenly reflecting acoustic vibrations outward from the housing 22. A series of support arms 36 extend from the reflector 34 and support the housing 22 above the reflector 34.

The reflector is similar to that disclosed in U.S. Patent Application Publication No. 2012/0076328 A1 to Harwood, which is incorporated in its entirety by reference herein. The Harwood '328 publication discloses an example distribution pattern for acoustic sound waves for the speaker 24 and the reflector 34.

Figure 2:
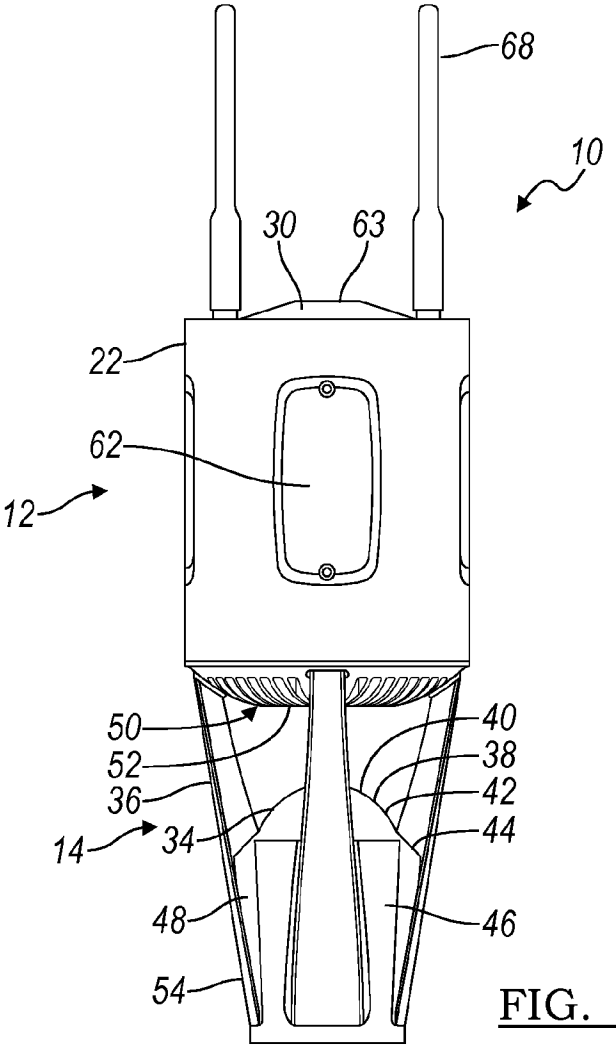
FIG. 2 is a side elevation view of the media assembly of FIG. 1.

FIG. 2 illustrates the reflector 34 in greater detail. The reflector 34 includes a central dome 38. The dome 38 has a peak 40, which is employed for reflecting pressure and low frequency vibrations from the speaker 24 back to the speaker 24 for acoustically tuning the speaker 24, amplifying movement of the speaker 24, and minimizing the size of the associated resonating chamber 32.

Direct application of a cone speaker results in uneven sound distribution. In order to optimize efficiency for all frequencies, the dome 40 extends toward the speaker 24 to provide uniform distribution of the frequencies out of the speaker assembly 14. Additionally, the low frequencies are reflected back to the speaker 24. Air that is moved by the speaker 24 is reflected off the peak 40 of the dome 38 and back to the speaker 24. The reflected frequencies and air pressure amplify the back pressure of the speaker 24, thereby tuning the speaker 24. Additionally, by amplifying the back pressure of the speaker 24, a smaller resonating chamber 32 is permitted in comparison to resonating chambers that are sized for a speaker that does not have amplified back pressure. By reducing the size of the resonating chamber 32, the size of the housing 22 is also reduced thereby minimizing the packaging required for concealing the speaker 24 and avoiding any drawback to the appearance of the overall indicator light assembly 12 and the speaker assembly 14.

The dome 38 is generally hemispherical-shaped. An outboard region 42 of the dome 38 is utilized for reflecting sound waves away from the reflector 34, such as the low frequency sound waves. Overall, the dome 38 is generally convex for reflecting pressure back to the speaker 24 and reflecting sound waves radially outward from the reflector 34.

The reflector 34 also includes a series of lobes 44 each extending radially outward from the dome 38. The lobes 44 are circumferentially spaced and have a generally flat acoustically reflective surface for reflecting the high frequency sound waves. The lobes 44 are provided interstitially about the perimeter of the dome 38 thereby providing gaps 46 between each sequential pair of lobes 44. The spacing of the lobes 44 and gaps 46 balances a distribution of the high frequency sound waves directed near the base of the support pole 16 and reflected away from the reflector 34. The gaps 46 permit the high frequency sound waves to pass between the lobes 44 to be conveyed to the underlying support surface. Thus, the lobes 44 and gaps 46 permit a balanced distribution of sound waves near the base of the pole 16 and away from the base of the pole 16.

In the depicted embodiment, the lobes 44 each have a uniform angular thickness that is equivalent to the angular spacing of the lobes 44 for an even distribution of the high frequency sound waves. Of course, the invention contemplates any variation of angular thickness of lobes 44 and angular spacing of the gaps 46 to control the distribution of the high frequency sound waves. Although the gaps 46 are illustrated between the lobes 44, the invention contemplates that the reflective surface of the lobes 44 may be provided circumferentially around the dome 38 with apertures formed therethrough for permitting the high frequency sound waves to pass. Although a radial array of four lobes 44 and four gaps 46 is illustrated, the invention contemplates any arrangement or array of lobes 44 and gaps 46.

Figure 3:
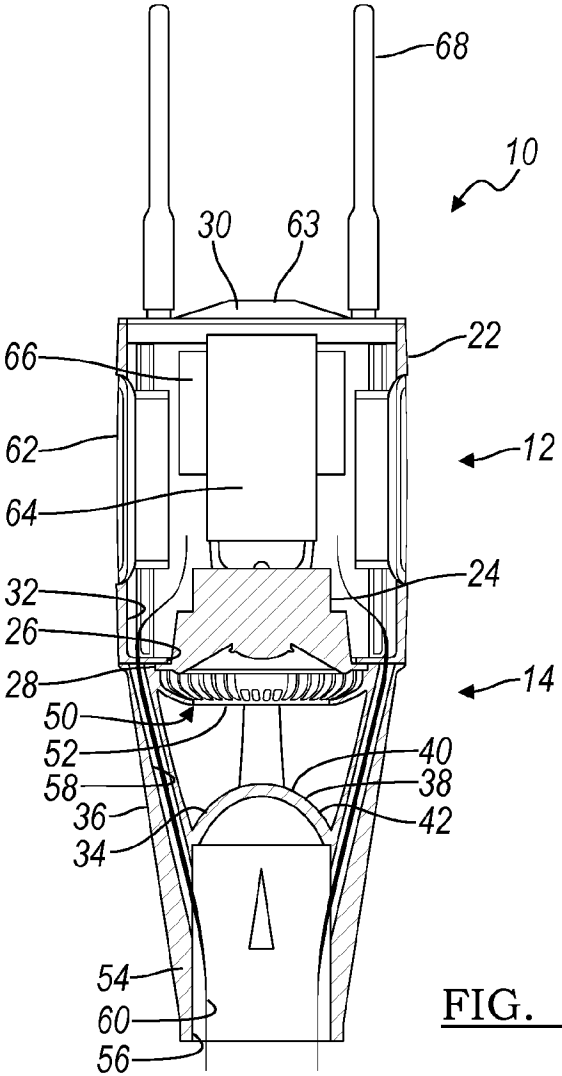
FIG. 3 is a partial section view of the media assembly of FIG. 1.

Referring again to FIGS. 1 to 5, the support arms 36 are each aligned with the lobes 44 as an example for maintaining a visual appearance of the lobes 44 and the associated support arms 36. Thus, the interstitial relationship of the lobes 44 and gaps 46 may be carried through the structure maintaining a uniform ornamental appearance. The spaced apart support arms 36 provide openings 48 between the support arms 36 for permitting sound to exit the media assembly 10. As illustrated in FIGS. 1 to 3, the lobes 44 extend radially outboard of a cross section of the dome 38 and the support poles 16 so that the gaps 46 are oriented directly at the underlying support surface. The support arms 36 have a width to externally visually conceal the corresponding lobes to provide a streamlined ornamental appearance that is not obfuscated by the functional features of the speaker assembly 14. Additionally, the integration of the support arms 36 and lobes 44 reduces wind loads.

The media assembly 10 provides a speaker assembly 14 with a concealed speaker 24 that is directed downward. Since the speaker 24 is directed downward, it is not exposed to the external environment and avoids collection of precipitation or external debris. By providing the speaker 24 coaxial to the pole 16 and the reflector 34, a symmetrical appearance is provided that is not obfuscated by an off center speaker assembly. Additionally, the symmetrical coaxial media assembly 10 and structural pole 16 has a uniform, uninterrupted structural integrity that does not increase wind loads or unintended collisions, which are associated with prior art speaker assemblies that are mounted off center from a pole.

The media assembly 10 includes a speaker grill 50 mounted to the housing 22 that is sized with apertures 52 for avoiding water retention.

The reflector 34 and the supports arms 36 are provided upon a base 54 that is adapted to be mounted atop the structural pole 16. For example, the base 54 includes a receptacle 56 for receipt of the top of the pole 16. The base 54, reflector 34, support arms 36 and speaker grill 50 may be formed integrally, such as from cast aluminum for a single modular unit for installation upon pole tops. Further, ducting 58 may be provided through the support arms 36 for wiring 60 from the support pole 16 to the housing 22. Although a receptacle 56 for pole mounting is illustrated, the media assembly 10 may be mounted in various configurations, such as a dedicated wall mount bracket, or alternatively, a wall mounted bracket configured to receive the receptacle 56 of the base 54.

With reference again to FIGS. 1 to 5, the indicator light assembly 12 includes a series of indicator light subassemblies 62 spaced about a perimeter of the housing 22 to be viewed omnidirectionally. Each of the indicator light subassemblies 62 is provided to convey a message, such as a warning, and therefore are spaced to be viewed from all external lines of sight. Thus, a spacing of four indicator light subassemblies 62 on ninety degree centers is adequate to convey the message in all external directions. According to one embodiment the indicator light subassemblies 62 are red, green, blue, amber (RGBA) flashers for flashing a security level warning. Various indicator light subassemblies 62 are contemplated. Each subassembly 62 is depicted as oriented vertically. However, the subassemblies 62 may be oriented horizontally, and may even form an indicator light ring about the periphery of the housing 22 and/or the cap 30. Additionally, an indicator light 63 may be provided upon the cap 30 for providing a signal to an overhead viewer, such as a traffic, safety, or rescue aircraft.

Figure 5:
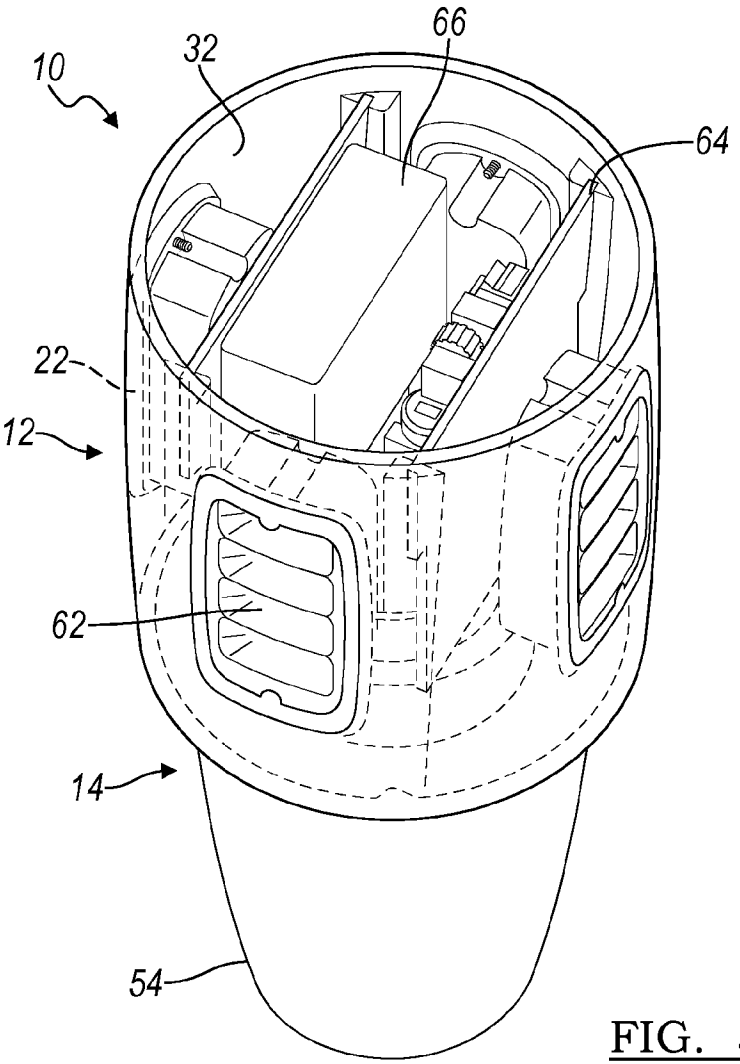
FIG. 5 is a partially disassembled perspective view of the media assembly of FIG. 1.
Figure 4:
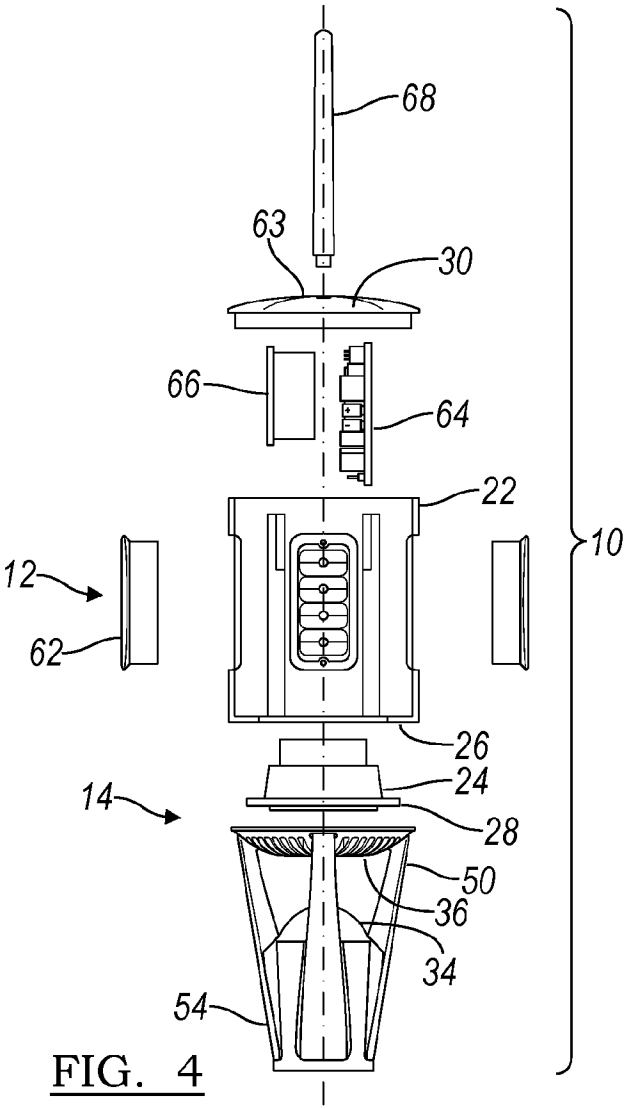
FIG. 4 is an exploded side elevation view of the media assembly of FIG. 1.

Referring to FIGS. 3 to 5, a power supply 64 is provided within the housing 22 for providing power to the components of the media assembly 10. Additionally, a controller 66, such as an electronic control module, is provided in the housing 22 for controlling the operation of features of the media assembly 10. The controller 66 may also control other features of the structural pole 16, such as the luminaire 20.

A pair of antennas 68 is mounted to the cap 30 for communication with external devices, such as other media assemblies 10. The communication may be for conveying information or media to be broadcast individually or synchronized from various media assemblies 10. Dual antennas are provided for redundancy and repeatability. The communications across media assemblies 10 permits mass notification by an audible message and/or flashing of the indicator light assemblies.

In contrast to the prior art, the media assembly 10 may be independent from a luminaire. In other words, the media assembly 10 may exclude a luminaire from the housing 22. The media assembly 10 may also be mechanically and electrically disconnected from an associated luminaire. Conversely, the wireless communication permits the controller 66 of the media assembly 10 to control the luminaire 20 of the associated structural pole 16. Likewise, the controller 66 may control the operations of luminaires 20 of other structural poles 16. By utilizing one controller 66 to control multiple devices, energy is saved that would otherwise power the redundant controllers 66. Further, costs are reduced by minimizing the quantity of controllers 66.

The invention contemplates that the media assembly 10 may incorporate a variety of additional features beyond audio and lighting. For example, sensors may be employed to measure temperature, moisture, air quality, radiation, wind velocity and the like. Cameras may be utilized for surveillance or for live monitoring of the applicable thoroughfare. Miniature photocells may be employed oriented in various directions without being readily identifiable by passersby. The media assembly 10 may also include receivers and/or transmitters, such as radio frequency or infrared, for analysis and/or on-site monitoring. Power and data interfaces or receptacles may be provided in the media assemblies for additional lighting (such as temporary or holiday lighting), signage, decorations, or the like. Each of these additional components may be oriented in the housings of the media assembly 10. The various features of the media assembly 10 may be controlled by the known techniques, such as those disclosed in Harwood U.S. Pat. No. 7,630,776 B2, the disclosure of which is incorporated by reference herein.

The media assembly 10 may be locally powered, self-powered (such as utilization of green technology to be solar or wind powered), or may be powered from a central amplifier. The media assembly 10 may be utilized as an original installation, or may be utilized as a stand-alone module to add functionality to an existing structural pole 16, without requiring replacement or modification of the existing luminaire 20. Additionally, by reflecting pressure to the speaker 24, a smaller speaker is required in comparison to prior art assemblies, thereby further minimizing power consumption and overall increasing the efficiency of the media assembly. The media assembly 10 provides ease in service and maintenance with the removable cap 30.

Alternatively, an additional media assembly may be mounted interstitially upon the housing 22 and supported upon the structural pole 16 by the media assembly 10. For example, a luminaire may be installed upon the housing 22 for cooperation with the media assembly 10. The cap 30 may be removed; and the antennas 68 may be relocated or extended into the luminaire.

Moreover, the modularity and flexibility of the media assembly 10 provide options to the end user for installation and cooperation with other devices without the dedicated ratio of devices to controller that was associated with the prior art.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker assembly comprising:

a speaker;

a housing mounted to the speaker;

a reflector spaced apart from and facing the speaker, the reflector having a generally convex central region and a plurality of circumferentially spaced lobes, each extending radially outward from the central region for reflecting acoustic vibrations from the speaker radially outboard from the reflector while providing gaps between the lobes for permitting acoustic vibrations to pass therethrough; and a series of supports connecting the housing and the reflector, the supports being spaced circumferentially about the housing for providing openings between the supports for an outlet of the reflected acoustic vibrations, wherein each of the series of supports is aligned with and externally partially visually conceals one of the lobes;

wherein each of the series of supports has an overall width that is different than an overall width of the corresponding lobe to externally, at least partially, visually conceal the corresponding lobe.

2. The speaker assembly of claim 1 wherein the speaker is oriented facing an underlying support surface; and wherein the speaker assembly further comprises a speaker grill mounted to the housing that is sized with apertures for avoiding water retention.

3. A media assembly comprising:

a structural support; and a speaker assembly according to claim 1 mounted upon the support.

4. The media assembly of claim 3 wherein the structural support further comprises a structural pole.

5. The media assembly of claim 3 wherein the lobes extend radially outboard of the structural support.

6. The media assembly of claim 3 wherein the structural support has a width that does not extend radially outboard beyond the central region of the reflector.

7. The media assembly of claim 3 further comprising a plurality of indicator light assemblies spaced about a perimeter of the housing to be viewed omnidirectionally.

8. The media assembly of claim 7 wherein the plurality of indicator light assemblies comprises four indicator light assemblies.

9. The media assembly of claim 7 wherein the plurality of indicator light assemblies comprises color outputs of red, green, blue and amber.

10. The media assembly of claim 3 further comprising wiring concealed within at least one of the supports.

11. The media assembly of claim 3 further comprising a power supply oriented within the housing.

12. The media assembly of claim 3 further comprising at least one antenna mounted to the housing.

13. The media assembly of the claim 12 further comprising a controller within the housing in communication with the antenna.

14. The media assembly of claim 12 wherein the at least one antenna comprises a pair of antennas.

15. The media assembly of claim 12 further comprising a cap mounted upon the housing, wherein the antenna is mounted upon the cap.

16. The media assembly of claim 3 further comprising a light assembly extending laterally from the structural support.

17. The media assembly of claim 3 further comprising an indicator light assembly oriented upon a top surface of the housing.

18. The speaker assembly of claim 1 wherein each of the plurality of lobes has a generally flat acoustically reflective surface to reflect high frequency sound waves.

19. The speaker assembly of claim 18 wherein the acoustically reflective surfaces of the plurality of lobes is not provided on the series of supports.

20. The speaker assembly of claim 1 wherein the overall width of each of the series of supports is less than an overall width of the corresponding lobe.

* * * * *